US005833808A

United States Patent [19]

Shands et al.

[11] Patent Number: 5,833,808

[45] Date of Patent: Nov. 10, 1998

[54] METHOD OF CONTROLLING CURL EMPLOYING INLINE HEADBOX EDGE FLOW CONTROL VALVE

[75] Inventors: Jay A. Shands, Beloit, Wis.; Thomas D. Rogers, Roscoe; Eugene B. Neill, South Beloit, both of Ill.

[73] Assignee: Beloit Technologies, Inc., Wilmington, Del.

[21] Appl. No.: 786,626

[22] Filed: Jan. 21, 1997

[51] Int. Cl.[6] ..... D21F 11/00; D21G 9/00

[52] U.S. Cl. ..... 162/198; 162/263; 162/336; 162/338; 162/258

[58] Field of Search ..... 162/198, 263, 162/336, 337, 338, 339, 258, 259

[56] References Cited

U.S. PATENT DOCUMENTS

| | | | |
|---|---|---|---|
| 2,956,623 | 10/1960 | Ikävalko | 162/336 X |
| 3,434,923 | 3/1969 | Dennis | 162/336 X |
| 3,562,107 | 2/1971 | Schmaeng . | |
| 4,285,767 | 8/1981 | Page . | |
| 4,517,056 | 5/1985 | Roerig et al. . | |
| 4,687,548 | 8/1987 | Ilmoniemi et al. | 162/216 |
| 4,726,883 | 2/1988 | Schroeder . | |
| 4,888,094 | 12/1989 | Weisshuhn et al. | 162/198 |
| 4,955,720 | 9/1990 | Blecha et al. | 356/429 |
| 5,147,509 | 9/1992 | Kuragasaki et al. . | |
| 5,183,537 | 2/1993 | Hergert et al. . | |
| 5,196,091 | 3/1993 | Hergert . | |
| 5,286,946 | 2/1994 | Will . | |
| 5,394,247 | 2/1995 | Vahey et al. . | |
| 5,466,340 | 11/1995 | Begemann et al. | 162/216 |
| 5,470,439 | 11/1995 | Makino et al. . | |
| 5,490,905 | 2/1996 | Houvila et al. | 162/212 |
| 5,545,293 | 8/1996 | Houvila et al. | 162/212 |
| 5,560,807 | 10/1996 | Hauser . | |
| 5,674,363 | 10/1997 | Houvila et al. | 162/216 |
| 5,674,364 | 10/1997 | Pikäjärvi | 162/216 |

FOREIGN PATENT DOCUMENTS

| | | |
|---|---|---|
| 42 39 845 A1 | 5/1993 | Germany . |

*Primary Examiner*—Stanley S. Silverman
*Assistant Examiner*—Jose A. Fortuna
*Attorney, Agent, or Firm*—Lathrop & Clark

[57] ABSTRACT

The headbox apparatus of this invention contributes to the production of a paper web of uniform fiber orientation by controlling the edge flow of stock into the headbox nozzle through adjustable valves positioned in edge tubes in closed loop with a fiber orientation sensor. At the same time that fiber orientation is being control through adjustable valves position in the edge tube, basis weight of the web being formed is controlled by a stock dilution systems and an adjustable slice lip, in closed loop with a basis weight profiler sensor.

10 Claims, 5 Drawing Sheets

METHOD OF CONTROLLING CURL EMPLOYING INLINE HEADBOX EDGE FLOW CONTROL VALVE

FIELD OF THE INVENTION

The present invention relates to papermaking headbox apparatus for providing a uniform flow of stock through a slice onto a forming wire.

BACKGROUND OF THE INVENTION

The art of papermaking involves depositing a stock of water and fibers through a headbox that discharges the stock through a long narrow converging nozzle. The fibers and water are discharged from the nozzle and deposited onto a wire screen or screens in the former section of the paper machine to form a continuous web of paper. The fibers are retained on the wire forming screen or screens while the majority of water is drawn through. The individual fibers retained on the forming screen or screens are joined together to make a paper web during a pressing and drying process. After formation the web is wound into reels that are later processed to produce smaller rolls or sets of paper for printing.

As a result of recently developed measurement techniques, many paper and board manufacturers have found that a correlation exists between certain product deficiencies and differences in fiber orientation. Some types of fiber orientation-related deficiencies include twist warp in liner board, diagonal curl in sheet cut fine and coated papers, and stack lean in forms bond. These differences in fiber orientation are most often attributed to cross-directional flows in the stock emanating from the headbox resulting from non-uniform flow across the width of the machine caused by the design or operation of the headbox. More specifically, a deficit of flow at the edges of a tube-bank can create an undesirable outward flow tendency in the headbox jet, or conversely, an excess edge flow can create an inward flow tendency. Both conditions can result in large, undesired fiber orientation angles.

Various means have been employed to enable adjustments to be made to the tube bank flow, including chamfering the edge tubes or installing inserts in specified tubes. However, these adjusting means are shutdown modifications, requiring down time which can have significant economic consequences in terms of lost production, and are often viewed merely as temporary methods, with no long term significance. These approaches are also susceptible to headbox cleanliness problems, such as clogging, and do not take into account other more dynamic factors that affect fiber orientation resulting from headbox cross flow tendencies, such as headbox header balance, slice lip profile, and use of pond-side bleeds. In addition, such modifications increase the significance of predicting the optimum edge flow relationship during the design stage for each headbox, when exact operating details are unknown. U.S. Pat. No. 5,470,439 to Makino et al. shows a system of valves for adjusting the flow of stock from a headbox along the pond sides. The valves allow adjustments of the flow of stock by a flow rate controller which receives data such as the lip opening degree, wire velocity, cross directional basis weight profile data and the like. However Makino et al. does not disclose a system which can in all circumstances control in realtime of the orientation of fibers in the web and basis weight of the web simultaneously especially when a twin wire former is employed.

What is needed is a system for controlling the edge flow of a headbox to simultaneously control the basis weight and fiber orientation of a paper web in real time.

SUMMARY OF THE INVENTION

The headbox apparatus of this invention contributes to the production of a paper web of uniform fiber orientation by controlling the edge flow of stock into the headbox nozzle through adjustable valves positioned in edge tubes in closed loop with a fiber orientation sensor. At the same time that fiber orientation is being controlled through adjustable valves positioned in the edge tube, basis weight of the web being formed is controlled by a stock dilution system and an adjustable slice lip, in closed loop with a basis weight profile sensor. The tube bank is made up of tubes arranged in cross machine rows and z-direction columns. The tubes extend from a stock inflow header to a converging nozzle chamber. Outermost columns of tubes are located at the edges of the tube bank and each outermost column of tubes has portions which define a valve cavity into which a rotating cylindrical valve control member extends. The valve control member has channels which align with the tubes in the outermost column when the valve is fully opened. Rotation of the control member increasingly obstructs the tubes in the outermost column, until a desired level of flow is obtained. The tubes of the outermost tube columns are preferably larger in diameter than the intermediate tubes to permit flows which are greater than or less than those through an intermediate tube column.

A fiber orientation sensor is positioned downstream from the headbox to detect non-uniformities in fiber orientation in the formed web. A controller is provided to actuate the outermost tube column valves in response to detected non-uniformities in fiber orientation to restore or maintain the proper fiber orientation. The valve control members are controlled using an actuator controlled from a source remotely located from the headbox apparatus.

Basis weight is controlled using a headbox with stock dilution conduits for basis weight control as described in U.S. Pat. No. 5,196,091 to Hergert in closed loop with a basis weight profile sensor and the controller. Basis weight is also controlled by adjusting a movable slice lip such as shown in U.S. Pat. No. 4,517,056 to Roerig et al. or U.S. Pat. No. 4,726,832 to Schroeder. The disclosures of U.S. Pat. Nos. 5,196,091; 4,517,056; and 4,726,832 are incorporated by reference herein.

It is a feature of the present invention to provide a headbox in a papermaking machine for producing paper webs of uniform fiber orientation.

It is also a feature of the present invention to provide a headbox that enables on the run tube bank flow adjustments to be made, to correct for, fiber orientation deficiencies in the resulting paper web.

It is another feature of the present invention to provide a closed loop system for producing optimum fiber orientation angles in a paper web.

It is an additional feature of the present invention to provide a mechanism in a headbox for controlling flow quantities in particular tubes of a tube bank with minimal interference with the direction of flow.

Further objects, features and advantages of the invention will be apparent from the following detailed description when taken in conjunction with the accompanying drawings.

DESCRIPTION OF THE PREFERRED EMBODIMENT

Figure 1:
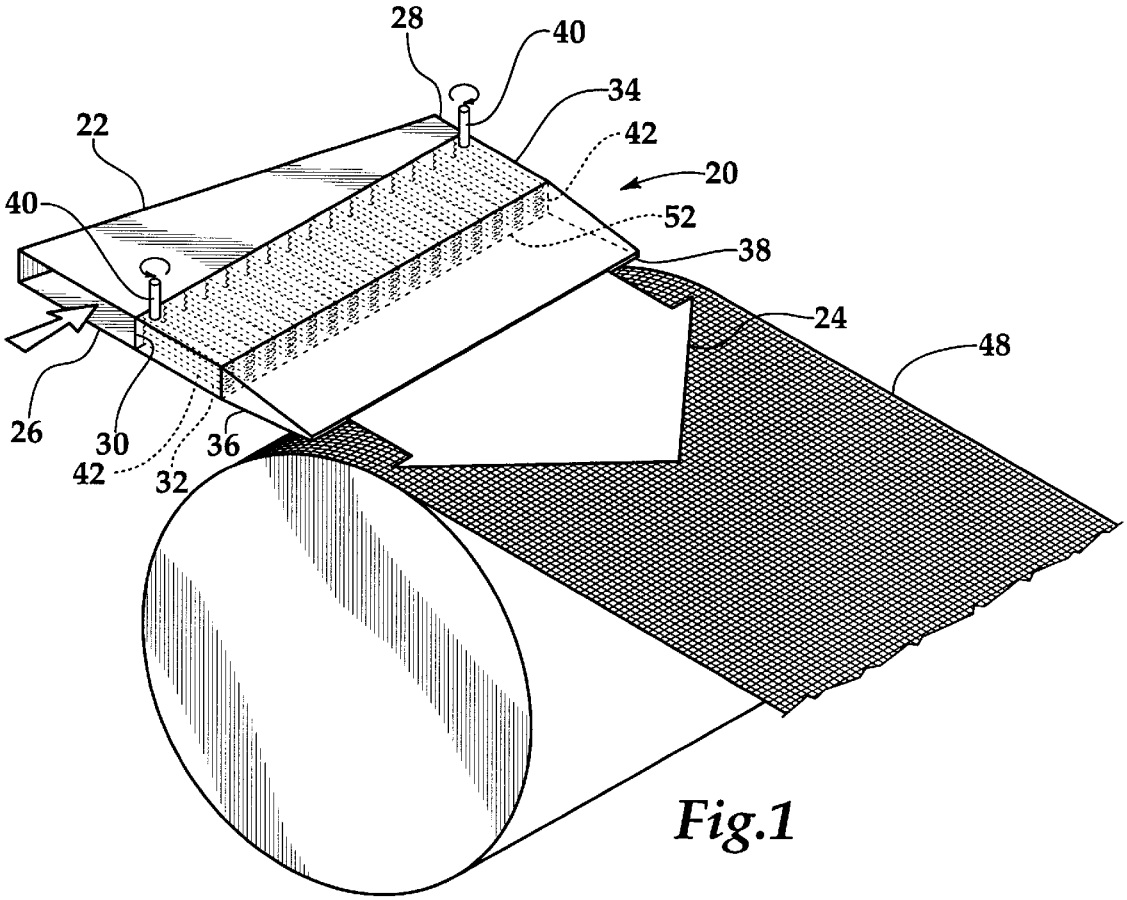
FIG. 1 is a simplified isometric view of the headbox of this invention discharging stock onto a papermaking machine forming wire.

Referring more particularly to FIGS. 1–14, wherein like numbers refer to similar parts, a headbox 20 is shown in FIG. 1. The headbox 20 has a tube bank 34 in which the flow through the outermost columns of tubes is adjustable to maintain uniformity of fiber orientation.

Figure 2:
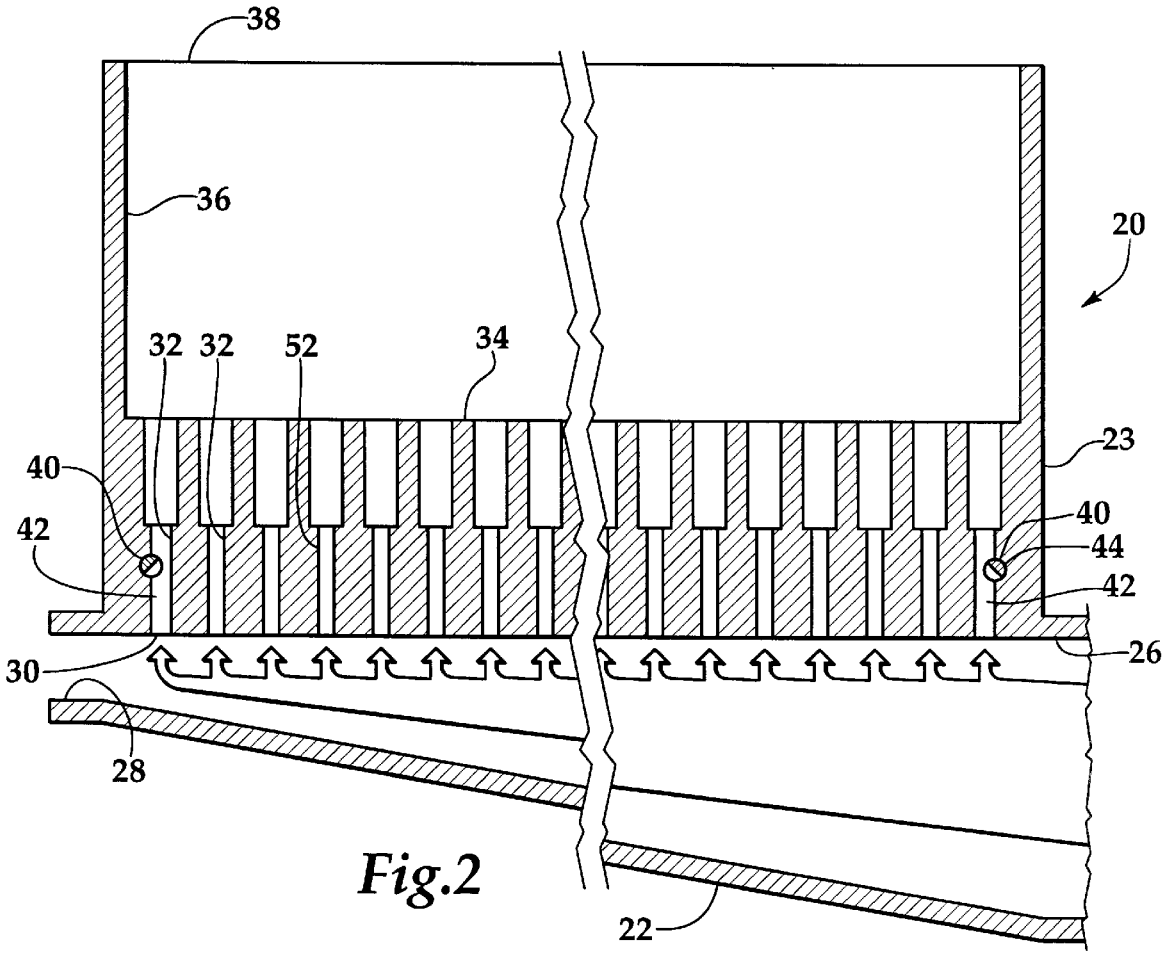
FIG. 2 an cross-sectional view of the headbox of FIG. 1 taken along section line 2—2, with the infed stock flows shown schematically.
Figure 3:
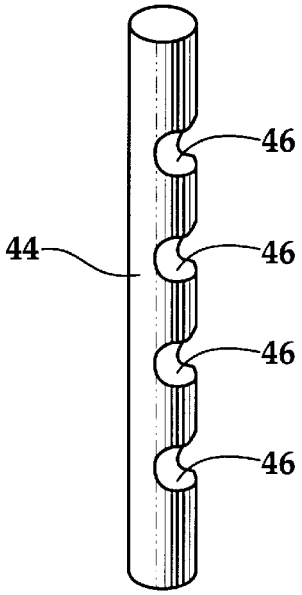
FIG. 3 is an enlarged isometric view of the valve member of a flow control valve of the headbox of FIG. 1

The headbox is supplied with paper stock by a header 22 which distributes infed stock across the width of the web 24 being formed. As shown in FIG. 2, stock flows through the header 22 in the cross machine direction from the header inlet 26, to a header outlet 28. An array of tubes 32 extend into the headbox nozzle 36 from a discharge wall 30 within the header. The individual tubes 32 form a tube bank 34 positioned in a tube bank housing 23 which directs the flow of stock in a controlled manner into the headbox nozzle 36, out the slice 38 and onto a forming wire or fabric 48. The header constricts as it extends from the header inlet 26 to the header outlet, with the aim of maintaining uniform flow rates through all the tubes 32. The tubes 32 are arranged in equally spaced rows and columns. The interior columns 52 of tubes are uniform in diameter and length. The two outermost columns 42, positioned one on each end of the tube bank, have a tube diameter greater than that of the interior columns. The individual tubes may have a conventional construction of a straight section of cylindrical pipe, followed by an expansion to a larger diameter, and then a constriction to a narrow slot exit, such as is disclosed in U.S. Pat. No. 5,560,807 to Hauser, the disclosure of which is incorporated by reference herein.

One of the difficulties involved in distributing the infed stock across the width of the web 24 involves non-uniformities in fiber orientation. This problem is most often attributed to the headbox design or operation. More specifically, non-uniform flow of stock through the tube bank 34 results in cross directional flows of the stock emanating from the headbox 20 as it flows onto the forming wire 48 to form the web 24. A deficit of flow at the outermost edges of the tube bank 34 can create an outward flow tendency in the flow of stock from the headbox 20 to the web 24. Conversely, excessive flow of stock at the outermost edges of the tube bank 34 tends to create an inward flow tendency. Both conditions can result in large, undesirable fiber orientation angles and a web of paper 24 that is disposed to undesirable failings such as twist warp in liner board, diagonal curl in sheet cut fine and coated papers, and stack lean in forms bond.

The headbox 20 of this invention provides a means for maintaining uniformity of flow within the nozzle and onto the forming wire by positioning stock flow control valves 40 in the outermost columns 42 of tubes 32 within the tube bank 34. By positioning the valves 40 to increase or decrease the flow of stock at the edges of the tube back, it becomes possible to control both excess flows and deficits in flows at the outermost edges of the tube bank 34 without the need to shut down the papermaking machine for adjustment to the flow to the edges of the tube bank.

In a preferred embodiment, each valve 40 extends through a cylindrical cavity 50 formed by the stacked tubes 32 within an outermost column 42. A generally cylindrical valve member 44, shown in FIG. 3, extends into the cavity 50 in each outermost column 42 of tubes. Concave channels 46 are formed in the valve member 44 aligned with each of the tubes 32 in the outermost column 42.

As shown in FIGS. 4–9, a valve member 44 is rotatable within the valve cavity 50 to control the opening size of the tubes in an outermost column 42 and to thereby control the flow of stock at the edges of the tube bank. This allows for a variation in the flow of stock through the tubes arranged in the outermost columns 42 at levels both greater than and less than the flow through the tubes 32 having a smaller diameter. The ability to vary the flow of stock at the outermost columns 42 of the tube bank 34 provides adjustments to be made to affect and correct for fiber orientation deficiencies.

Figure 4:
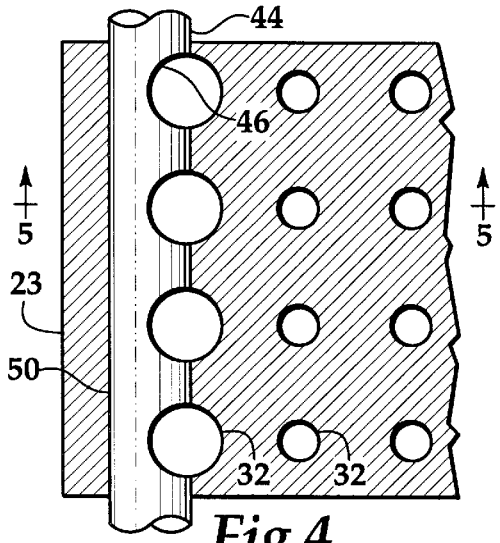
FIG. 4 is a fragmentary cross-sectional view of the tube bank of FIG. 2 taken along section line 4—4 and shown in the valve full open position.
Figure 5:
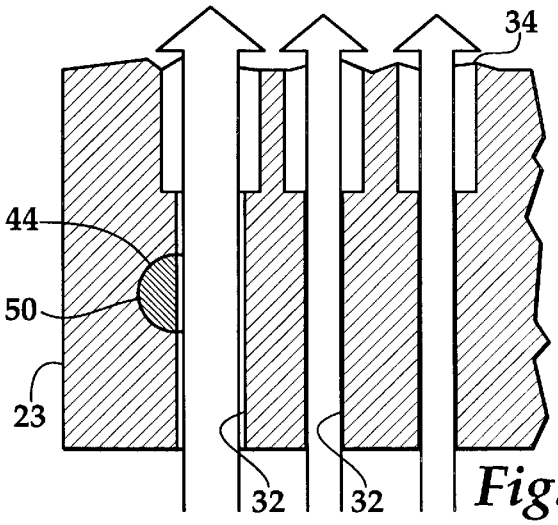
FIG. 5 is a cross-sectional view of the tube bank of FIG. 4 taken along section line 5—5.
Figure 6:
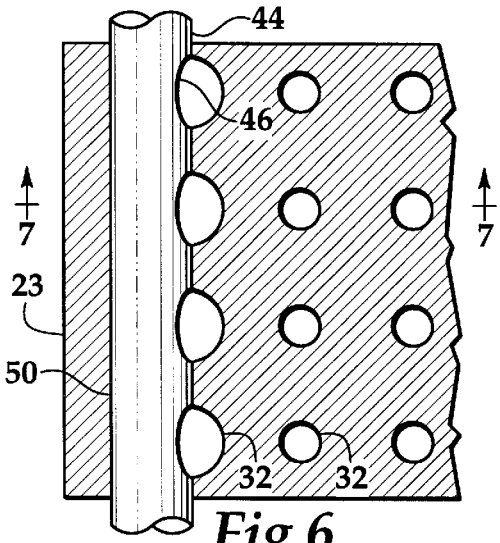
FIG. 6 is a fragmentary cross-sectional view of the tube bank of FIG. 4 with the valve in a partially closed position.
Figure 7:
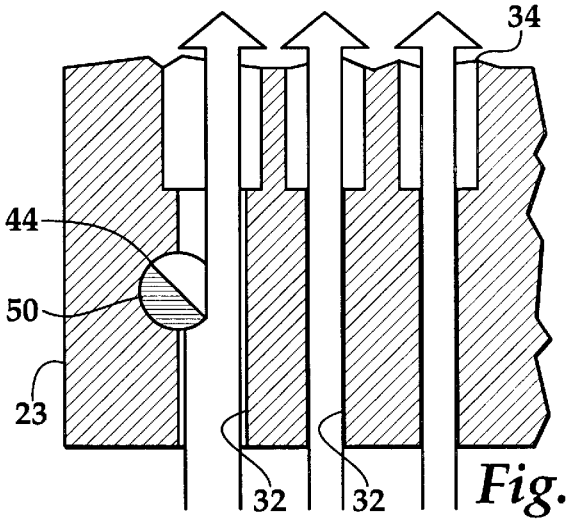
FIG. 7 is a cross-sectional view of the tube bank of FIG. 6 taken along section line 7—7.
Figure 8:
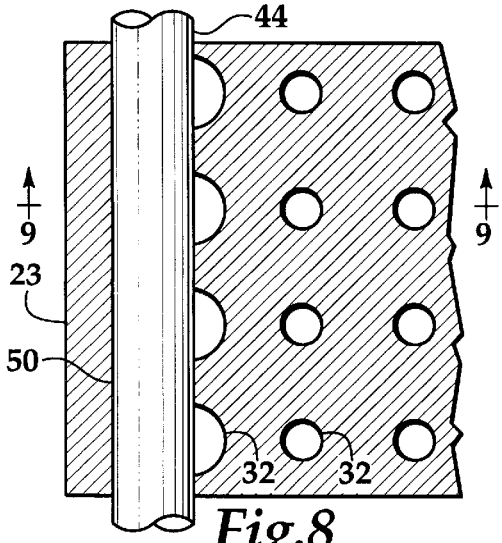
FIG. 8 is a fragmentary cross-sectional view of the tube bank of FIG. 6 with the valve in its most restricted position.
Figure 9:
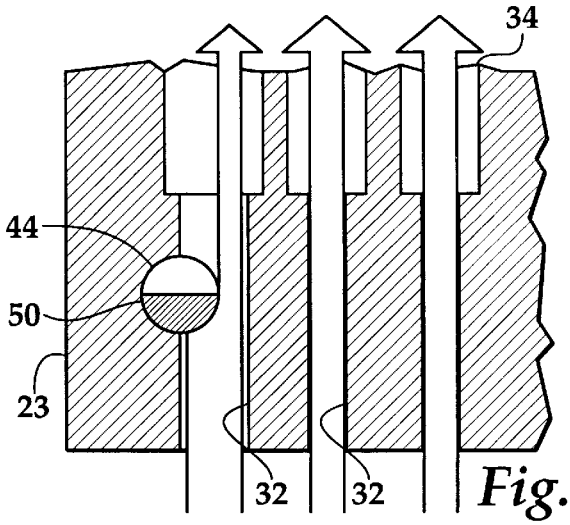
FIG. 9 is a cross-sectional view of the tube bank of FIG. 8 taken along section line 9—9.

In operation, as shown in FIGS. 4–9, the position of the valve 40 can be rotated over a range of flow obstruction between a fully opened position, shown in FIGS. 4 and 5, and a maximum restriction position, shown in FIGS. 8 and 9. In the fully open position, the valve member 44 is oriented such that the channels 46 allow the stock to flow unobstructed through the tubes 32 in the outermost column 42 of tubes. Because the outermost column tubes are larger in diameter than the interior tubes, when the valve 40 is fully opened the flow through the outermost column tubes may be greater than that through an interior column tube. As a result, the volume of flow through the outermost column 42 of tubes can be compensated to adjust for a deficit of flow at the edges of the tube bank 34, and thereby alleviate outward flow tendencies of the stock on the web 24.

By rotating the valve members 44 from the fully open position, the outermost tubes may be partially obstructed and the flow therein reduced. In the partially closed position, shown in FIGS. 6 and 7, the valve member 44 is rotated from the fully open position such that the channels 46 partially obstruct the flow of stock through the tubes 32 of the outermost column 42 such that the volume of flow through all of the tubes 32 of the tube bank 34 is relatively equal, as shown in FIG. 7.

In the maximum obstruction position, shown in FIGS. 8 and 9, the valve 40 is rotated to a position in which the channels 46 of the valve member 44 are not presented to the flow of stock. As a result, the volume of flow through the outermost column 42 of tubes is obstructed by the valve member 44 so that it is less than the volume of flow through the other tubes 32, as shown in FIG. 9. In this way, the flow at the edges of the tube bank 34 can be compensated to adjust for excessive edge flow, and thereby alleviate inward flow tendencies of the stock on the web 24. It is preferred that the valves 40 at no time be fully closed, to continue a constant flow of stock through all tubes at all times to prevent accumulation of fiber within the tubes.

The valve 40 can be operated through the use of a valve actuator (not shown) which is controlled from a controller 56 to produce a closed loop automatic control system.

Closed loop control is a process whereby the commanded operation of a mechanical system, such as opening a valve, is related to a sensor monitoring the commanded action so the action may be modified according to a control logic in response to the real response of the mechanical system. For example if a closed loop control system is used to open a valve, and the valve has a valve position sensor, as the valve is commanded to open a control logic can be used to maximize the speed at which the valve opens by controlling the valve opening rate so the valve's motion is in accord with mechanical limits of the valve. Other parameters such as minimizing hydraulic loads or preventing valve damage due to closing on an obstruction could be incorporated in a closed loop valve control system. Closed loop control is responsive to the actual response of the thing being controlled. Closed loop control is particularly desirable when the parameter being controlled is a nonlinear function of the controlling action. The control logic or laws can be predetermined or can be learned from the previous responses of the system. Such a learning system is known as an adaptive control system. In controlling fiber orientation the excess or shortage of stock supplied to the edges of the pond, as determined by the pond side valves 40, bears a complicated relationship to fiber orientation. Thus a closed loop control system, optionally supplied with adaptive or fuzzy logic, will be most effective at achieving the desired result of controlling fiber orientation and controlling the tendency of the paper to curl.

Figure 10:
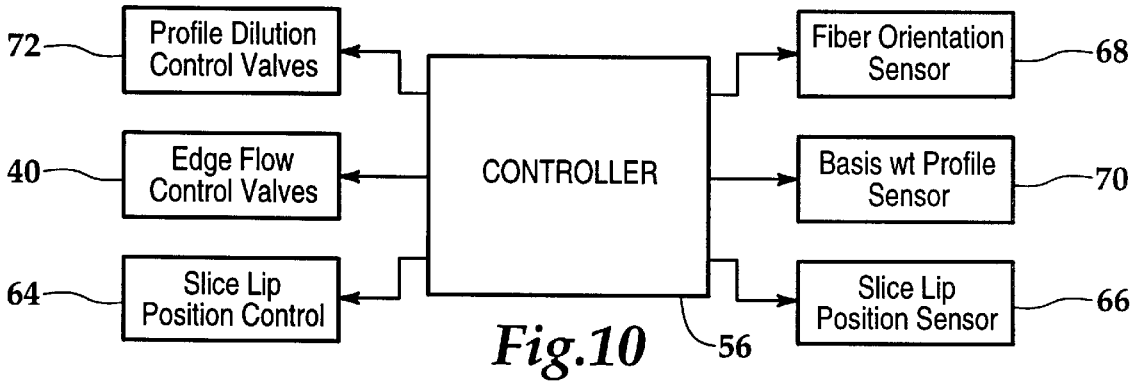
FIG. 10 is a block diagram of a controller and it's inputs and outputs for controlling fiber orientation and basis weight of a paper web.
Figure 12:
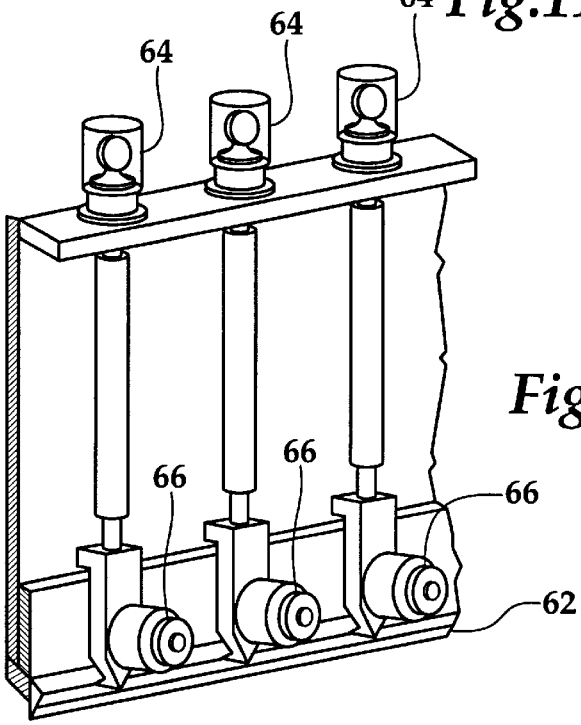
FIG. 12 is a fragmentary isometric view of slice lip positioned actuators controlled by the controller of FIG. 10.
Figure 13:
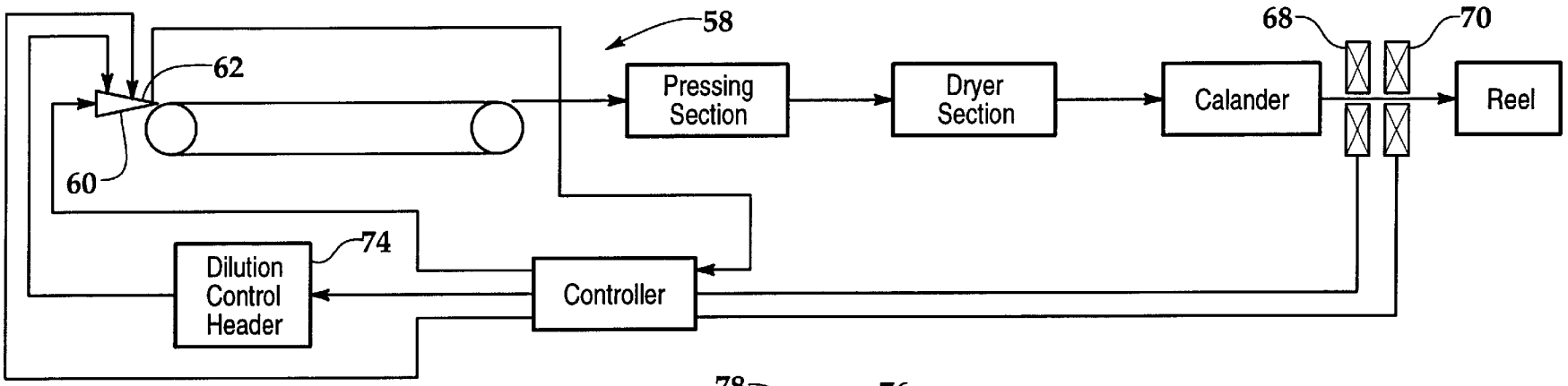
FIG. 13 is a schematic view of a papermaking machine and with sensors and actuators for detecting and controlling basis weight, fiber orientation in a paper web.

As shown in FIG. 10, a controller 56 can be used to receive inputs from sensors positioned along a papermaking machine 58 as shown in FIG. 13. The papermaking machine 58 has a headbox 60 which incorporates pond side valves such as the valves 40 shown in FIGS. 1–9. The headbox 60 also includes a controllable slice lip 62 shown in FIG. 12. Examples of typical controlled slice lips include U.S. Pat. Nos. 4,726,883 and 4,517,056 assigned to Beloit Corporation. As shown in FIG. 12 the lip 62 is moved by an actuator 64. The motion of the actuator 64 is detected by a sensor 66. The sensor 66 is shown schematically in FIG. 10. FIGS. 10 and 13 also show the use of a fiber orientation sensor 68 and consistency profile sensor 70. Consistency profile sensors are well known to those skilled in the art, and fiber orientation sensors are now becoming available as illustrated by U.S. Pat. No. 5,394,247 to Vahey et al. which is incorporated herein by reference.

Figure 14:
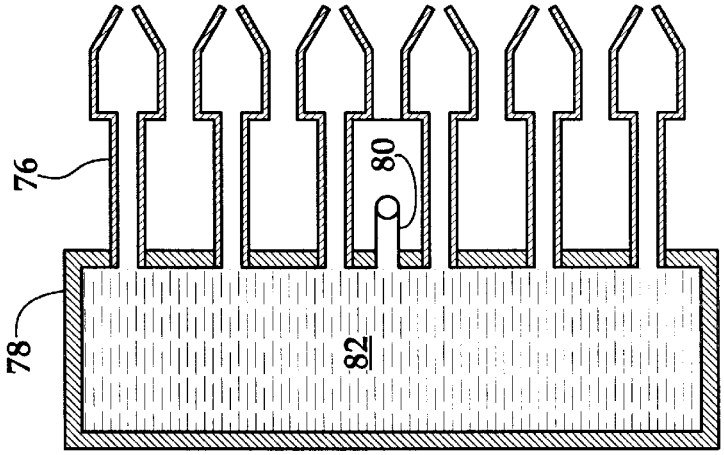
FIG. 14 is a schematic cross-section view of a headbox employing stock dilution for basis weight control.

The controller 56 has outputs 72 for controlling dilution control valves (not shown) which are mounted to a dilution control header 74. As described in U.S. Pat. No. 5,196,091 which is incorporated herein by reference, the basis weight of a paper web can be controlled by the addition of dilution water to the headbox 60. FIG. 14 shows a stock manifold or header 78 in cross-section with individual tubes 76 receiving stock from the header 78. Dilution injection ports 80 from the dilution control header 74 supply white water to dilute the stock 82 for purposes of controlling the basis weight of the paper web 84 in the cross machine direction.

Figure 11:
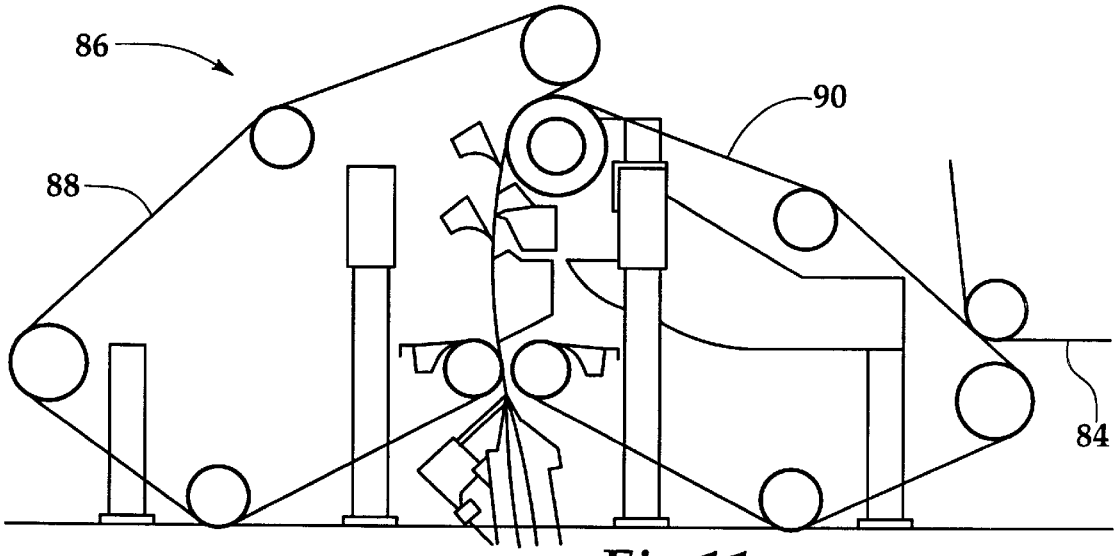
FIG. 11 is a schematic elevational view of a twin-wire former employing the controller of FIG. 10.

The use of dilution control tubes 76 normally will eliminate the need for controlling the slice lip to control web basis weight in the cross machine direction. However where a twin-wire former 86 such as shown in FIG. 11 is employed to form the paper web the first wire 88 and second wire 90 can produce a squeezing effect near the edges of the wires 88, 90. This squeezing effect overwhelms the ability of the profile dilution control system to maintain uniform cross machine direction basis weight. However by controlling the slice lip, sufficient control is available to control basis weight at the same time the pond side valves 40 control fiber orientation in the web.

Thus, as illustrated in FIG. 10, the controller 56 has three inputs from the fiber orientation sensor 68, basis weight profile sensor 70, and the slice lip position sensor 66. The controller 56 has three outputs for controlling the action of the profile dilution control valves 72, the edge flow control valves 40, and the slice lip position controls 64. In a particular application for controlling the fiber orientation a single fiber orientation sensor 68 may be utilized in closed loop control with the edge flow valves 40.

Typically many factors are influencing the fiber orientation in a paper web being formed, for example the jet velocity to forming wire velocity ratio, the absolute speed of paper formation and the basis weight of the paper being formed. Thus no simple relationship exists between the value being controlled: the position of pond edge control valves 40; and the desired result: uniform orientation of the fibers in the web along the machine direction. Thus a closed loop controller 56 utilizing adaptive or fuzzy logic attempts to control the fiber orientation while monitoring the results of manipulating the controlled parameters, here the valves 40.

Additional controlled parameters allow the controller 56 greater capability in controlling a particular parameter. On the other hand the addition of another parameter to be controlled, such as basis weight profile, reduces the ability of the controller 56 to achieve a given level of control. Additional informational inputs also allows better control of a particular parameter. The inherent physical attributes of a particular papermaking machine play a role in the level of control achievable. Thus for a twin-wire former control of slice lip position in addition to dilution control of basis weight, is likely to be necessary to achieve basis weight uniformity simultaneously with fiber orientation control.

It should be understood that the particular control laws and the type of loop closure, employing fixed control logic, adaptive control logic, or fuzzy control logic are machine and system specific. However the more parameters being controlled and the more complex the underlying physical relationship between the parameters being control and the mechanical system for controlling the parameters, the greater the need for adaptive or fuzzy control logic.

It should be noted that the use of valves on either end of the tube bank as disclosed above is but one means for controlling fiber orientation in the stock discharged onto the forming fabric. Other known means for controlling fiber orientation could also be employed, for example, after the tube bank in the nozzle section stock could be added or removed through injection ports or bleed ports respectively. Such an approach might be particularly called for in a modification to an existing conventional headbox.

It is understood that although the illustrated embodiment employs the use of a valve at both edges of the tube bank, a similar embodiment could employ the use of a single valve located at one of the tube bank edges.

It is understood that the invention is not limited to the particular construction and arrangement of parts herein illustrated and described, but embraces such modified forms thereof as come within the scope of the following claims.

We claim:

1. A papermaking machine comprising:

a headbox supplying stock onto a forming fabric, wherein the headbox has a header and a slice;

a controllable lip mounted to the slice;

a tube bank composed of a plurality of tubes extending in the machine direction from the header along an outlet wall, the tubes being positioned within a tube bank housing and forming a plurality of stacked rows each row having a plurality of tubes spaced in the cross machine direction, the stacked rows forming a plurality of tube columns, wherein portions of the tube bank housing and the tubes of an outermost tube column define a first valve cavity, the tubes receiving a flow of stock from the header; and a first valve having a valve control member extending into the first valve cavity, wherein the valve control member has portions defining a plurality of openings, and wherein the valve control member is adjustable to selectably block the flow of stock through the outermost column of tubes;

a dilution profile control system supplying dilution water to discrete locations on the outlet wall along the headbox header, said discrete locations being spaced from one another in the cross machine direction;

a basis weight profile sensor mounted to the papermaking machine downstream of the forming fabric for determining basis weight of a paper web as it is formed on the papermaking machine;

a fiber orientation sensor mounted to the papermaking machine downstream of the forming fabric for determining the orientation of fibers within the paper web as it is formed on the papermaking machine; and a controller in data-receiving relationship to the basis weight profile sensor and in data-receiving relationship with the fiber orientation sensor, the controller controlling the slice lip, the profile dilution system, and the first valve, to form means for simultaneously controlling in closed loop relation the curl and basis weight of the paper web.

2. The papermaking machine of claim 1 further comprising a second forming fabric co-running with the forming fabric to form a twin wire former.

3. The papermaking machine of claim 1 further comprising a slice lip position sensor, wherein the controller is in data-receiving relationship with the lip position sensor, the controller comprising a means for closed loop control of lip position.

4. The papermaking machine of claim 2 wherein the controller further comprises:

a first means for closed loop control of basis weight utilizing the basis weight sensor and the dilution profile control system;

a second means for closed loop control of fiber orientation utilizing the fiber orientation sensor and the first valve; and a third means for closed loop control of basis weight utilizing the basis weight profile sensor, the slice lip actuators, and the dilution control system.

5. A method for forming a continuous web of paper on a papermaking machine, the web having improved fiber direction uniformity and improved uniformity of basis weight profile, the method comprising the steps of:

forming a continuous web of paper from a headbox onto at least one forming fabric, the headbox having a tube bank composed of a plurality of tubes positioned within a tube bank housing, the tubes forming a plurality of stacked rows with tubes spaced in the cross machine direction, the stacked rows forming a plurality of tube columns, wherein portions of the tube bank housing and the tubes of an outermost tube column define a first valve cavity, and wherein each tube extends in the machine direction and opens into a header along an outlet wall to receive a flow of stock from the header, and a pond side valve having a valve control member extending into the first valve cavity, wherein the valve control member has portions defining a plurality of openings, and wherein the valve control member is adjustable to selectably block the flow of stock through the outermost column;

measuring the fiber orientation of the web of paper downstream of the headbox; and controlling the pond side valve in closed loop with the fiber orientation sensor to minimize the tendency of the formed web to curl.

6. The method of claim 5 further comprising the step of measuring basis weight profile of the web of paper downstream of the headbox and employing a closed loop control system including a basis weight dilution control system to control the uniformity of paper web basis weight in a cross machine direction.

7. The method of claim 6 further comprising the step of controlling a movable slice lip mounted to the headbox in a closed loop system with the measured basis weight profile.

8. A headbox apparatus for a papermaking machine for producing a paper web from an infed stock, the headbox apparatus comprising:

a header for distributing the infed fiber stock across the width of the machine, the header having an outlet wall;

a tube bank composed of a plurality of tubes positioned within a tube bank housing, the tubes forming a plurality of stacked rows of tubes spaced in the cross machine direction, the stacked rows forming a plurality of tube columns, wherein portions of the tube bank housing and the tubes of an outermost tube column define a first valve cavity, and wherein each tube extends in the machine direction and opens into the header along the outlet wall to receive a flow of stock from the header;

a first valve having a valve control member extending into the first valve cavity, wherein the valve control member has portions defining a plurality of openings, and wherein the valve control member is adjustable to selectably block the flow of stock through the outermost column;

a nozzle chamber following and in direct flow communication with the header by means of the tube bank, wherein the nozzle chamber has an upper wall which converges toward a lower wall, and is spaced from the lower wall to define a slice outlet, and wherein the tubes are parallel and extend from the outlet wall to the nozzle chamber; and a sensor positioned downstream from the headbox in the machine direction to detect non-uniformity in fiber orientation of the infed stock on the paper web, wherein a controller is connected to receive fiber orientation data from the sensor, and wherein the controller is connected to adjust the valve control member.

9. The headbox apparatus of claim 8 further comprising:

an adjustable slice lip positioned at the nozzle chamber slice outlet, wherein fluid discharged from the tube bank passes through the slice lip onto a forming fabric; and a slice lip position sensor, wherein the controller is in data-receiving relationship with the lip position sensor, the controller comprising a means for closed loop control of lip position.

10. The headbox apparatus of claim 8 further comprising a means for introducing white water into the header at the outlet wall, wherein the controller is connected to the means for introducing white water, to thereby adjust the flow of white water in response to detected irregularities in fiber orientation.

* * * * *